US005513669A

United States Patent [19]

Springer

[11] Patent Number: 5,513,669

[45] Date of Patent: May 7, 1996

[54] SAFETY UMBRELLA

[76] Inventor: Dan Springer, 718 Grand St., Apt. 5, Hoboken, N.J. 07030

[21] Appl. No.: 410,963

[22] Filed: Mar. 27, 1995

[51] Int. Cl.[6] ..... A45B 25/02

[52] U.S. Cl. ..... 135/27; 135/335

[58] Field of Search ..... 135/27, 31, 33.5, 135/37

[56] References Cited

U.S. PATENT DOCUMENTS

| | | | |
|---|---|---|---|
| 688,037 | 12/1901 | Sparry | 135/33.5 X |
| 728,035 | 5/1903 | Sprague | 135/33.5 |
| 1,051,698 | 1/1913 | Daggett | 135/33.5 X |
| 1,706,341 | 3/1929 | Zussman | 135/33.5 X |
| 2,784,727 | 3/1957 | Fleischer | 135/33.5 |
| 4,202,858 | 5/1980 | Bruce et al. . | |
| 4,872,468 | 10/1989 | Cole . | |
| 5,277,212 | 1/1994 | Aronov | 135/27 |

*Primary Examiner*—Lanna Mai

[57] ABSTRACT

The safety umbrella of the invention employs a handle, wherein a flexible canopy is mounted in a reciprocal manner about the handle, with the canopy extending from a handle end portion from which an annular array of radial ribs project. The radial ribs support the canopy in the opened and closed positions, with the radial ribs terminating in generally U-shaped free ends that are maintained in alignment by spaced annular rails of continuous construction.

1 Claim, 3 Drawing Sheets

SAFETY UMBRELLA

TECHNICAL FIELD

The field of invention relates to umbrella structures, and more particularly to a safety umbrella wherein the outer annular peripheral rim of the umbrella is configured to have the ribbed tips curled in a generally U-shaped configuration to prevent projecting tips that may cause injury and damage in use of the umbrella structure.

BACKGROUND OF THE INVENTION

Prior art umbrellas of various types are indicated in the prior art and exemplified by the U.S. Pat. Nos. 4,202,858 and 4,872,468.

The instant invention is directed to improvements over prior art umbrellas wherein the ribbed tips do not project beyond the outer annular rim of the umbrella canopy.

SUMMARY OF THE INVENTION

The safety umbrella of the invention employs a handle, wherein a flexible canopy is mounted in a reciprocal manner about the handle, with the canopy extending from a handle end portion from which an annular array of radial ribs project. The radial ribs support the canopy in the opened and closed positions, with the radial ribs terminating in generally U-shaped free ends that are maintained in alignment by spaced annular rails of continuous construction.

Objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DESCRIPTION OF THE PREFERRED EMBODIMENT

As required, detailed embodiments of the present invention are disclosed herein; however, it is to be understood that the disclosed embodiments are merely exemplary of the invention, which may be embodied in various forms. therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
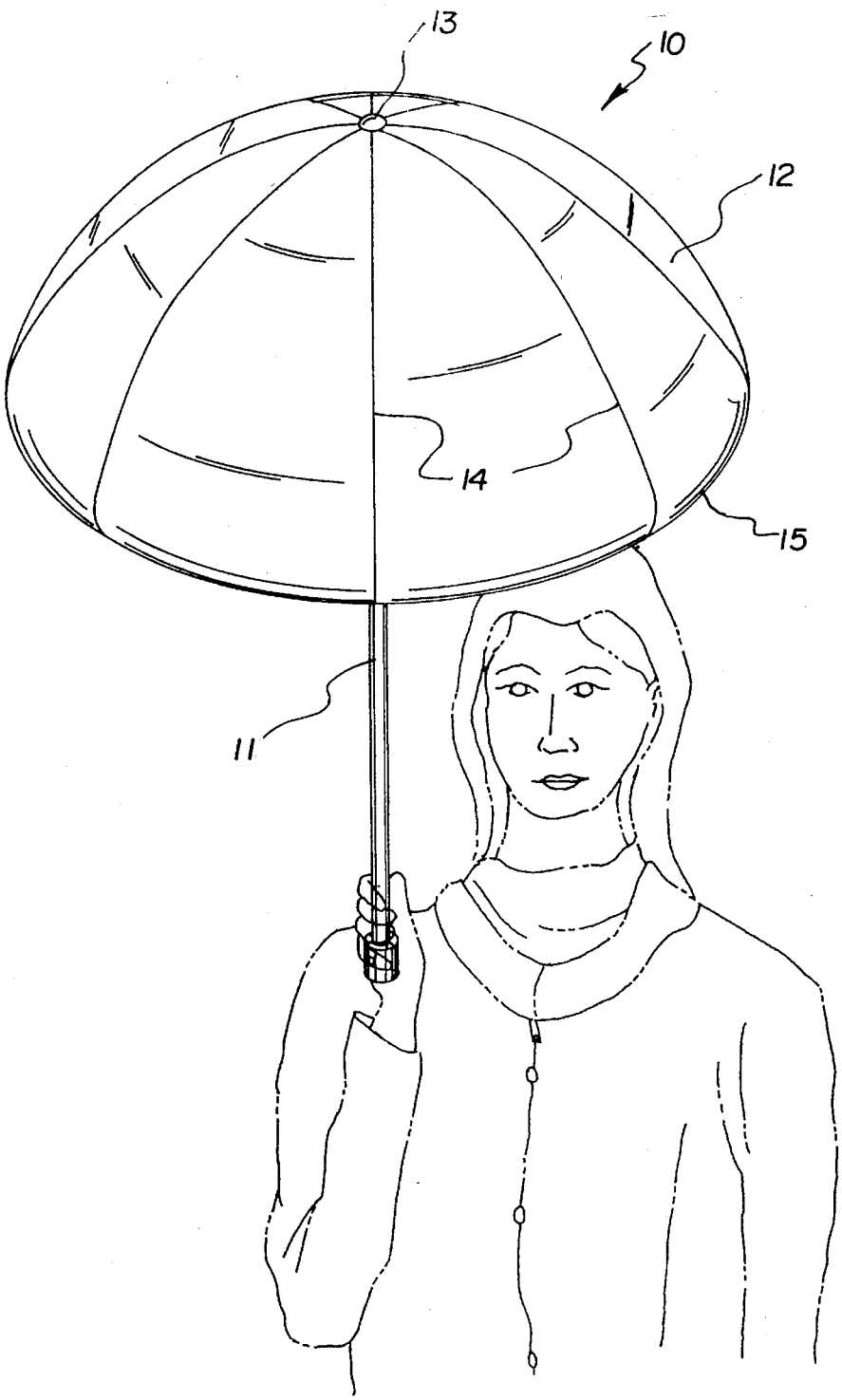
FIG. 1 is a perspective illustration of the invention.
Figure 2:
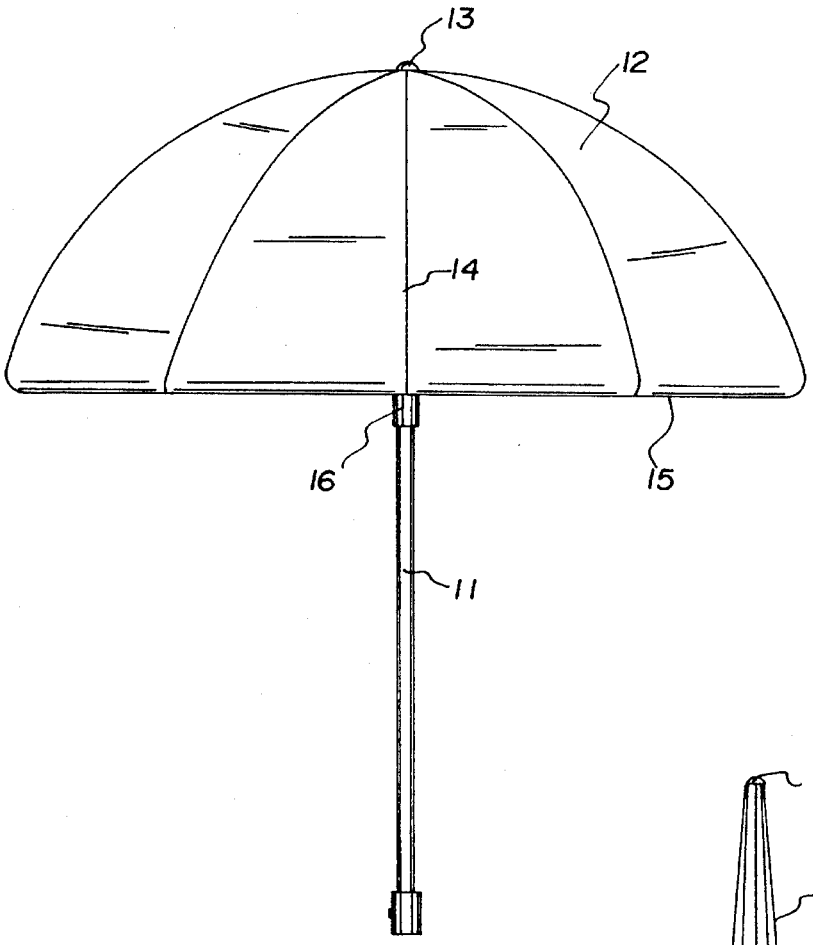
FIG. 2 is a side view, taken in elevation, of the umbrella in an opened configuration.
Figure 3:
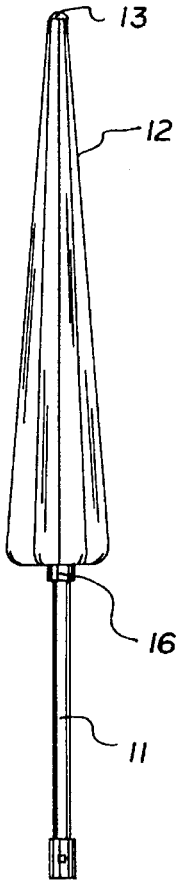
FIG. 3 is a side view, taken in elevation, of the umbrella of the invention in a closed configuration.

The safety umbrella 10 of the invention, as indicated in the FIGS. 1–3, employs an elongate rigid handle 11 having a handle free end and a handle canopy end 13 spaced from the handle free end, wherein typically as illustrated in FIG. 1, an individual grasps the handle 11 adjacent the handle free end. From the handle canopy end 13 extend an annular array of radial ribs 14 spaced in an annual array about the handle canopy end 13, such that a flexible canopy 12 encompasses the radial ribs 14 with the handle canopy end 13 oriented medial of the flexible canopy 12. The flexible canopy is arranged for opening and closing in a conventional manner, such that the mechanism is mounted to a slide yoke 16 slidable about the handle 11.

Figure 4:
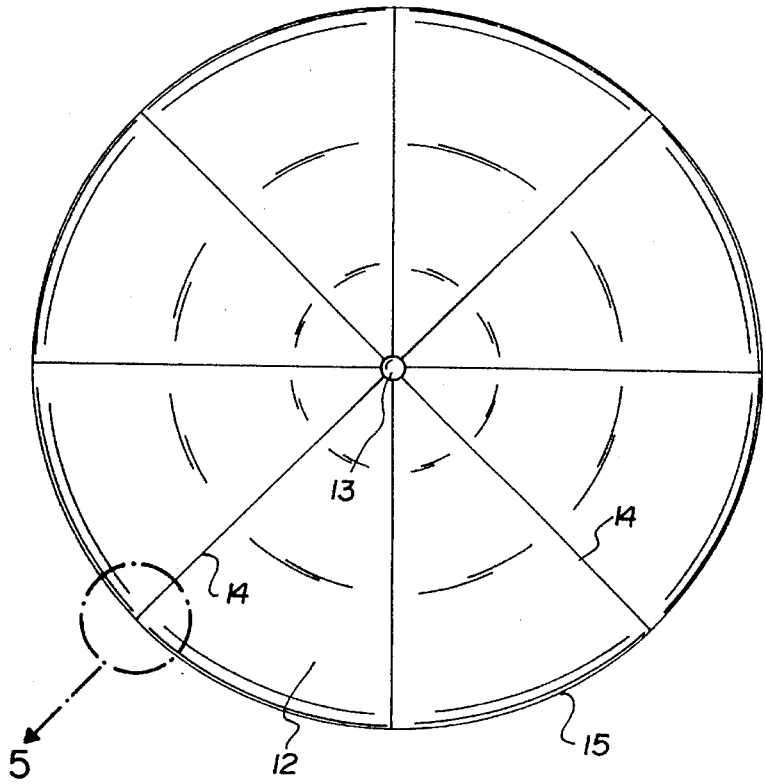
FIG. 4 is a top plan view of the umbrella of the invention.
Figure 5:
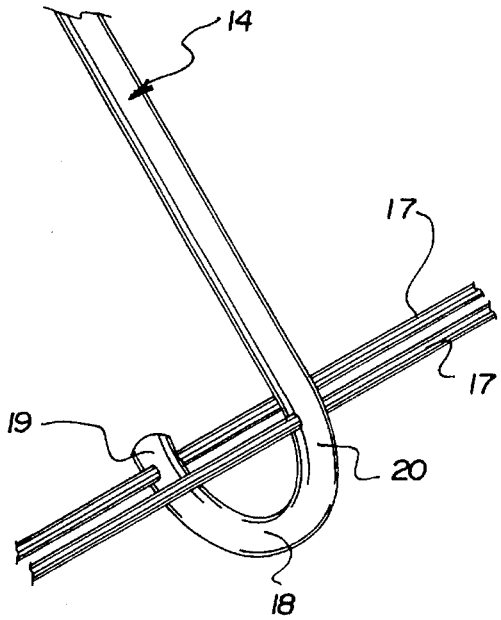
FIG. 5 is an enlarged perspective illustration of the rib end structure as employed by the invention.

With specific reference to the FIGS. 4 and 5, each of the radial ribs 14 terminates in a rib U-shaped free end 18 spaced from the handle canopy end 13. Each of the U-shaped ribs free ends 18 are defined by spaced first and second legs 19 and 20. Extending through a first leg 19 is one of a plurality of annular rails 17. The annular rails are arranged concentrically relative to the handle canopy end 13 and are of a flexible construction to maintain alignment of the U-shaped free ends of the ribs 18. The first leg 19 as noted receives one of the annular rails 17, while the second leg 20 receives a further one of the annular rails 17 to thereby maintain the U-shaped free ends in a manner to avoid projection of any of the ribs beyond the canopy annular periphery 15.

It is to be understood that while certain forms of the present invention have been illustrated and described herein, it is not to be limited to the specific forms or arrangement of parts described and shown.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed and desired to be protected by LETTERS PATENT of the United States is as follows:

1. A safety umbrella, comprising, a rigid handle, the handle having a handle free end spaced from a handle canopy end, and a flexible canopy secured to the handle, with the handle intersecting the flexible canopy medially thereof, and an annular array of radial ribs extending from the handle canopy end having the flexible canopy secured thereto, with the flexible canopy arranged for opening to a first position defining a generally semi-spherical configuration, with the canopy closing to a second position having the flexible canopy directed against the handle, with the canopy in the first position defining an annular periphery, and the radial ribs terminating in rib end portions, and each end portion of said portions oriented between the annular periphery and the handle canopy end;

each of the end portions define a generally U-shaped configuration, and a plurality of flexible annular rails, and each of the end portions having a first leg spaced from a second leg, and one of the rails directed through each said first leg and a further one of said annular rails directed through each said second leg.

* * * * *